United States Patent [19]

Rubinfeld

[11] 4,061,603

[45] * Dec. 6, 1977

[54] DETERGENTS

[75] Inventor: Joseph Rubinfeld, Northport, N.Y.

[73] Assignee: Colgate-Palmolive Company, New York, N.Y.

[ * ] Notice: The portion of the term of this patent subsequent to Sept. 14, 1993, has been disclaimed.

[21] Appl. No.: 699,774

[22] Filed: June 25, 1976

Related U.S. Application Data

[60] Division of Ser. No. 446,228, Feb. 27, 1974, Pat. No. 3,980,588, Continuation of Ser. No. 231,367, March 2, 1972, abandoned, which is a division of Ser. No. 56,123, July 2, 1970, abandoned, which is a continuation of Ser. No. 553,622, May 31, 1966, abandoned.

[51] Int. Cl.[2] ..... C11D 3/07

[52] U.S. Cl. ..... 252/548; 252/135; 252/536; 252/534; 252/551; 252/555

[58] Field of Search ..... 252/536, 555, 534, 548, 252/551

[56] References Cited

U.S. PATENT DOCUMENTS 3,980,588 9/1976 Rubinfeld ..... 252/548

FOREIGN PATENT DOCUMENTS 818,158 8/1959 United Kingdom ..... 252/548

*Primary Examiner*—Mayer Weinblatt

*Attorney, Agent, or Firm*—Richard N. Miller; Murray M. Grill; Herbert S. Sylvester

[57] ABSTRACT

Blend of olefin sulfonate detergent with other detergents such as sulfates of higher alcohol or alkylbenzene-sulfonates.

4 Claims, No Drawings

DETERGENTS

This application is a divisional of application Ser. No. 446,228 filed Feb. 27, 1974, now U.S. Pat. No. 3,980,588, which application is a continuation of application Ser. No. 231,367 filed Mar. 2, 1972, now abandoned, which is a divisional of application Ser. No. 56,123 filed July 2, 1970, now abandoned, which is a continuation of application Ser. No. 553,622 filed May 31, 1966, now abandoned, whose entire disclosure is incorporated herein by reference.

Olefin sulfonate detergents may be produced by the continuous reaction of long chain alpha-olefins in liquid condition with gaseous $SO_3$ highly diluted with an inert gas, using a mole ratio of $SO_3$ to olefin of about 1:1 to 1.3:1. This reaction produces a viscous acidic product which is believed to contain alkenyl sulfonic acids and sultones. On further treatment, as a hydrolysis and neutralization (e.g. by treatment with strong aqueous alkali), sultones in the product are converted to the corresponding hydroxyalkanesulfonic acids. The product, containing long chain alkenyl sulfonic acid and hydroxyalkane sulfonic acid may then be extracted ("deoiled") to remove water-insoluble inactive material such as sultones, to improve the detergent power of the mixture. The yield of detergent may be increased and the "free oil" content reduced by treatment of the sulfonation product with strong sulfuric acid prior to neutralization (as disclosed in the copending application of Rubinfeld and Ouw entitled SULFONATION, Ser. No. 548,827 filed May 10. 1966, which also discloses the details of the intitial olefin-$SO_3$ reaction and of the materials used therefor). The olefin sulfonate detergents may contain minor quantities of disulfonates, presumably produced in the course of the sulfonation treatment by reaction of excess $SO_3$ with the alkenyl sulfonate formed during sulfonation.

In accordance with one aspect of this invention, I have discovered that highly effective detergent compositions of desirable foaming power may be prepared by blending the aforementioned products of the continuous sulfonation of α-olefins with other detergents, such as higher fatty alcohol sulfates or higher alkylbenzenesulfonates.

The olefin sulfonate detergent is preferably used in the form of a sodium salt, but it is within the broader scope of the invention to use other water-soluble salts, e.g. potassium, ammonium, triethanolammonium, etc.

Examples of sulfates of higher alcohols are sodium lauryl sulfate, sodium tallow alcohol sulfate, Turkey Red Oil of other sulfated oils, or sulfates of mono- or di-glycerides of fatty acids (e.g. stearic monoglyceride monosulfate), alkyl poly (ethenoxy) ether sulfates such as the sulfates of the condensation products of ethylene oxide and lauryl alcohol (usually having 1 to 5 ethonoxy groups per molecule); lauryl or other higher alkyl glyceryl ether sulfonates; poly(ethenoxy)ether sulfates such as the sulfates of the condensation products of ethylene oxide and nonyl phenol (usually having 1 to 6 oxyethylene groups per molecule).

The alkylbenzenesulfonate detergent may contain about 8 to 16 carbon toms in the alkyl group. Particularly suitable examples are the sodium dodecyl or tridecyl benzene sulfonates which are well known in the art. The alkyl group may be essentially linear (and biodegradable) or branched chain (e.g. derived from propylene tetramer) and the alkylbenzenesulfonate may be a blend containing various alkyl chain lengths.

Examples of other anionic detergents which may be added are paraffin sulfonates, such as the reaction products of alphaolefins and bisulfites (e.g. sodium bisulfite) which are primary paraffin sulfonates of about 10–20, preferably about 15–20, carbon atoms; soaps; sulfates of higher alcohols; salts of α-sulfofatty esters (e.g. of about 10 to 20 carbon atoms, such as methyl α-sulfomyristate or α-sulfotallowate).

Example of soaps are those of fatty acids such as lauric, myristic, stearic, oleic, elaidic, isostearic, palmitic, undecyclenic, tridecylenic, pentadecylenic or other saturated or unsaturated fatty acid of 11 to 18 carbon atoms. Soaps of dicarboxylic acids may also be used such as the soaps of dimerized linoleic acid. Soaps of such other higher molecular weight acids such as rosin or tall oil acids, e.g. abietic acid, may also be employed. Other suitable anionic surface active agents are the carboxyl-containing amides of fatty acids with amino acids (e.g. the lauric acid amide of such amino acids as sarcosine, beta amino propionic acid, polypeptides from hydrolysis of proteins, isethionic acid or N-methyl tauric acid) and soluble salts of such carboxyl-containing amides.

The hydrocarbon radicals of any added anionic detergent materials preferably contain at least about 10 (e.g. 10–20) carbon atoms, long chain hydrophobic aliphatic radicals of about 11–18 carbon atoms being particularly suitable, and the cations of the added anionic detergents are advantageously such as to impart water-solubility to the acidic portion of the molecule or to maintain its water-solubility, e.g. sodium, potassium, triethanolammonium, diethanolammonium, or other alkanolammonium, magnesium (when the surface active agent forms a water-soluble magnesium salt), or ammonium.

The added detergent may be a nonionic or amphoteric detergent. Among the nonionic detergents are the lower alkylene oxide condensation products of hydrophobic compounds which are preferably of 10 to 30 carbons, e.g. ethylene oxide condensates with higher fatty acids, higher fatty acid amides, higher fatty alcohols or alkyl aryl hydrocarbons, having at least 5 and usually from about 5 to 30 oxyethylene groups per molecule. The corresponding higher alkyl mercaptans or thioalcohols, or polyoxypropylene glycols of at least 900 molecular weight condensed with a sufficient number of ethylene oxide groups as known in the art may be used also. Other nonionics are the alkylolamine condensates of higher fatty acids and ethylene oxide condensates thereof, such as lauric and myristic diethanolamide, coconut fatty acid diethanolamide, and the like. Among the amphoteric detergents, usually having an alkyl group of 10–18 carbons, are fatty or higher alkyl imidazolines, such as 1-coco-5-hydroxyethyl-5 carboxymethyl imidazoline known as Miranol CM; and the N-higher alkyl beta-alanines such as docecyl beta-alanine or N-dodecyl iminodipropionic acid (e.g. the materials known as Deriphats); the carboxylic group of the amphoteric detergent may be in the acid form or in the form of the water-soluble salt (e.g. Na salt). Further examples are the disodium salt of 1-lauryl-cycloimidium-2-ethoxy-ethionic acid-2-ethionic acid and its corresponding 2lauryl sulfate derivative.

It is preferred that the proportion of added detergent be at most about twice the amount of the olefin sulfonate, e.g. about 5 to 1255 of the weight of the olefin sulfonate, but it is within the broader scope of the invention to employ larger amounts. Generally the ratio of the amount of added detergent to olefin sulfonate detergent is in the range of about 90:10 to 30:70, or more preferably about 85:10 to 40:60.

A further aspect of the present invention includes the formation of an aqueous slurry having a total solids content of about 30 to 80% by weight, preferably 40 to 75%, in which the sulfonated olefin and the added detergent material are in solution or dispersion admixed with a major proportion of water-soluble builder salts, such as having a ratio in the range of about 1:1 to 1:20, preferably 2:5 to 1:10, of organic detergent to inorganic builder salts. The mixture is agitated in any suitable mixing vessel at an elevated temperature as described to form a substantially homogeneous mixture which is flowable (including pumpable). A particularly desirable feature which facilitates processing is the de-foaming power or substantial inhibition or elimination of undesirable foam during the mixing operation due to the presence of the sulfonated olefin therein. The mixture can be sent into a drop tank if desired, and then dried.

The builder salt may be of a type well known in the detergent art generally and may be any suitable alkali metal, alkaline earth metal, or heavy metal salt or combinations thereof. Ammonium or an ethanolammonium salt in a suitable amount may be added also, but generally, the sodium and potassium salts or similar salts are preferred. Examples are the water-soluble sodium and potassium phosphates, silicates, carbonates, bicarbonates, borates, sulfates and chlorides. The builder salts contribute detersive efficiency when used in combination with the salt of the sulfonated olefin. Particularly preferred builder salts are the alkaline builder salts such as polyphosphates, pyrophosphates, silicates, borates, etc. Both Phase I and Phase II sodium tripolyphosphate and mixtures thereof may be successfully used in the compositions. The usual commercial tripolyphosphate consists mainly of the Phase II material. The tripolyphosphate material is usually essentially tripolyphosphate, e.g. 87–95% , with small amounts, e.g. 4–13%, of other phosphates, e.g. pyrophosphate and orthophosphate. Sodium tripolyphosphate in its hydrated form may be used also. Other phosphate salts are tetrasodium pyrophosphate, sodium hexametaphosphate, sodium trimetaphosphate, and the like, including mixtures thereof. Suitable silicates are sodium silicates having a $Na_2O$ to $SiO_2$ ratio of 1:2.35, 1:2.5, 1:3.2, and so forth. Other suitable materials are borax and sodium carbonate. The proportion of builder salt is preferably, for example, in the range of about 1 to 20 parts per part of the anionically active sulfonate.

Various other materials may be added in suitable amounts. Materials such as the higher fatty acid amides may be added to improve detergency and modify the foaming properties in a desirable manner. Examples thereof are the higher fatty acid alkanolamides, preferably having 2–3 carbons in each alkanol group and a fatty acyl radical within the range of 10–18 carbons, preferably 10–14 carbons, such as lauric or myristic monoethanolamides, diethanolamides and isopropanolamides. Tertiary higher alkyl amine oxides such as having about 10–18 carbons in one alkyl group, e.g. lauryl or myristyl dimethylamine oxide, may be added also. Fatty alcohols of 10–18 carbons such as lauryl or coconut fatty alcohols, or cetyl alcohol are suitable additives also. A hydrotropic material such as the lower alkyl aryl sulfonates, e.g. sodium toluene- or xylene-sulfonates, can assist processing also. In general, these materials are added in minor amounts, usually from about ½ to 10%, preferably 1 to 6% based on the total solids.

The mixtures may also contain optical brightening agents or fluorescent dyes (e.g. in amounts in the range of about 1/20 to ½%); germicidal ingredients such as halogenated carbanilides, e.g. trichlorocarbanilide, halogenated salicylanilide, e.g. tribromosalicylanilide, halogenated bis-phenols, e.g. hexachlorophene; halogenated trifluoromethyldiphenyl urea; zinc salt of 1-hydroxy-2-pyridinethione and the like (e.g. in amounts in the range of about 1/50 to 2%); soil-suspending agents such as sodium carboxymethyl cellulose or polyvinyl alcohol, preferably both, or other soluble polymeric materials, such as methyl cellulose (the amount of suspending agent being, for example, in the range of about 1/20 to 2%); antioxidants such as 2,6-di-tert-butylphenol, or other phenolic antioxidant materials (e.g. in amounts in the range of about 0.001 to 0.1%), coloring agents, bleaching agents and other additives.

The alpha-olefins feedstock to be sulfonated may contain, for example, olefins of 8–25 carbon atoms, e.g. 10–22, preferably 12–21 carbon atoms. The feedstock may contain minor amounts of other constituents such as secondary or internal olefins, diolefins, cyclic olefins, aromatics, naphthenes and alkanes, and may be produced by cracking of petroleum wax, catalytic polymerization of ethylene, dehydration of long chain alcohols, etc. Best results have thus far been obtained when the alpha-olefins constitute a major proportion, e.g. above 70% and preferably at least 90%, of the feedstock. A particularly preferred olefin feedstock contains in the range of about 12 to 21 carbon atoms in the molecule and yields alkenyl sulfonates having excellent detergency properties. Especially good foaming a detersive characteristics have been obtained by the use of a feedstock whose alpha-olefin content consists essentially of compounds of 15 to 18 carbon atoms. Olefin sulfonates made from olefin feedstocks containing substantial amounts (e.g. over 15%) of olefins having 19 and 20 carbon atoms do not perform as well as those made from the $C_{15}$–$C_{18}$ cut.

In the sulfonation reaction the inert gas:$SO_3$ mole (volume) ratio is generally in the range of 5:1 to 100:1 , preferably at least about 10:1, e.g. 50:1 to 20:1.

Among the inert gases which may be used for dilution of the sulfur trioxide are air and nitrogen, which are preferred, carbon dioxide, sulfur dioxide, low molecular weight paraffinic hydrocarbons, etc. The gaseous sulfur trioxide may be provided by vaporizing a stabilized liquid sulfur trioxide or by using converter gas obtained from a sulfur burner.

In carrying out the initial $SO_3$-olefin reaction, it is advantageous to maintain intimate contact between a supply of gaseous $SO_3$ and the olefin. This may be conveniently effected in a continuous manner by exposing to the $SO_3$ one or both faces of a thin flowing film of olefin, as by passing the thin film of olefin down the wall of a tube into the inner portion of which the $SO_3$ is injected.

During the intitial $SO_3$-olefin reaction the temperture is advantageously maintained below 60° C, a temperature of less than about 50° C and, when feasible, not above about 40° C (e.g. within the range of about 10°–40° C) being preferred. It is usually desirable to work at a temperature at which the sulfonated material produced by the reaction remains in liquid condition. Accordingly, the choice of a particular temperature is in part dependent on the particular olefin used, since the sulfonated products of higher molecular weight, e.g. those made from $C_{20}$ olefins, will tend to precipitate out of the mixture more readily, at low temperatures, than the lower molecular weight sulfonated products (e.g. those made from $C_9$ olefins). In general, it is desirable to use as low a temperature as possible, e.g. a temperature which is 5° C, or less, above the temperature at which freezing or precipitation takes place. Since the reaction between the $SO_3$ and the olefin is exothermic, it is advantageous to use suitable cooling means; thus, cooling may be effected by passing a cooling medium, such as water, through a jacket surrounding the tubular reactor in which the $SO_3$-olefin reaction takes place.

The gaseous effluent leaving the reactor after the contact between the $SO_3$ and olefin is generally substantially free of $SO_3$, and consists practically entirely of the inert gas, together with a very small amount of $SO_2$ and some entrained reaction mixture.

The product of the $SO_3$-olefin reaction (hereinafter termed "Stage I mix", for convenience) is usually a dark brown viscous material, having an appearance similar to a melted chocolate bar. Typical Stage I mixes, made with a 1:1 $SO_3$: olefin mole ratio, contain in the neighborhood of about 35 mole % active ingredients (based on moles of olefin and measured by titration of the acidic mix with a standard cetyl trimethylammonium bromide solution); on heating with aqueous caustic, to effect neutralization of the sulfonic acids and hydrolysis, by ring-opening, of some of the sultones, this proportion rises to about 70% or higher. The neutralization and hydrolysis of this mixture may be effected, for example, by heating the product for several hours at 90°-100° C with sufficient excess aqueous sodium hydroxide to maintain the pH at at least 8 (e.g. 8-12) during the treatment.

In the manufacture of the most preferred sulfonation products, sulfuric acid is incorporated into the Stage I mix. Advantageously, the sulfuric acid is supplied as a separate stream, being added as an aqueous solution (e.g. a 60% sulfuric acid solution) or as 100% sulfuric acid or as oleum (e.g. 65% oleum). 20% oleum has given excellent results, as has sulfuric acid supplied as a 90% or 97% solution; the latter are preferred over the oleum because of economy in use of material and production of lighter colored products. The optimum quantity of sulfuric acid incorporated in this stage of the process is dependent on the reaction conditions in this stage and in the initial stage. Generally, the amount of added sulfuric acid will be in the range of about 2 to 300 parts by weight per 100 parts of Stage I mix. For Stage I mixes made with 0.8 -1.2 mole of $SO_3$ per mole of olefin the amount of added sulfuric acid is preferably in the range of 2 to 100, e.g. 2 to 50, parts by weight per 100 parts by weight of Stage I mix. Even when a 60% $H_2SO_4$ aqueous solution is employed, the amount of water supplied in the added acid is small, e.g. less than 10% of the weight of the Stage I mix; in the preferred process it is less than 5%, usually less than 3%. Thus, the sulfuric acid treatment takes place under substantially non-hydrolyzing conditions, in contrast to treatment in dilute aqueous medium.

The sulfuric acid treatment is preferably effected at a temperature sufficient to keep the mixture in a flowable state. The temperatures may, for example, be in the range of about 10 to 100° C, preferably in the range of about 25° to 60° C. The duration of the sulfuric acid treatment is advantageously relatively short, preferably less than about an hour, best results being obtained with times of less than about 20 minutes, e.g. 5 minutes or less. Good results have been obtained even when the sulfuric acid was injected into the Stage I mix less than one minute before the mixture was brought into contact with an alkaline neutralizing agent (e.g. excess aqueous NaOH); in one run the Stage I mix was blended with the sulfuric acid and heated to about 55° C during a period of about 13 seconds and then directly neutralized.

The addition of the sulfuric acid may be effected in any suitable apparatus, preferably one in which the ingredients are mixed together thoroughly and quickly. One suitable technique for continuous operation is to feed the Stage I mix and sulfuric acid to a recycle loop. Good results have also been obtained when the sulfuric acid was injected into the Stage I mix while the latter was passing through the sulfonation apparatus; e.g. when a tubular falling film tower was employed, as previously described, with the olefin and diluted $SO_3$ fed to the top of a vertical tube 20 feet high, the sulfuric acid was injected at a point halfway up the tube. Still another method for carrying out the treatment is to feed the sulfuric acid and Stage I mix to a pump at one end of a length of tubing leading, without recycling, to a neutralization zone.

The appearance of the sulfuric acid-treated material is similar to that of the Stage I mix; that is, it is a viscous dark material, again like a melted chocolate bar.

After the treatment with the sulfuric acid, which as previously pointed out may be very brief, the treated material is preferably fed directly into contact with a basic material to neutralize it. It is, however, within the broader scope of this invention to give the material an intermediate treatment, preferably a thermal treatment, which may be effected in aqueous medium, prior to neutralization. Thus, after treatment with sulfuric acid under non-hydrolyzing conditions and in the presence of little or no water, the material may be mixed with water, or with dilute sulfuric or other acid, and heated (e.g. to 100° C or higher, e.g. 150°-200° C under superatmospheric pressure) before neutralizing it by contact with a basic material.

The treatment of the sulfuric acid-treated material with base may be carried out on a batch or continuous scale. Advantageously, it is effected by thoroughly mixing the acidic product with a basic material and water, e.g. with a 10, 20, 30, 40 or 50% aqueous solution of sodium hydroxide and, conveniently, maintaining the mixture at an elevated temperature above 60° C. e.g. in the range of about 65°-200° C (using superatmospheric pressures for the higher temperatures, when needed), preferably in the range of about 90°-100° C. The neutralization goes to completion much more rapidly for the sulfuric acid treated material than for the Stage I mix, previously described. Neutralization times well under an hour may be employed, e.g. ½ hour or less without the danger of the gradual auto-acidification of the product on storage. Generally, the alkali is used in amount such that the pH of the resulting aqueous solution is about 10 or higher; this makes for easier manufacturing control than the use of an amount precisely sufficient to give a pH of 7 or 8. When the sulfuric acid treatment is effected under such conditions as to produce a treated material having a very low sultone content, the alkali treatment conditions are preferably made less drastic; for example, the alkali treatment may be effected at room temperature with short contact times.

The product of the aqueous base treatment is generally a syrupy liquid when the starting olefin includes an appreciable proportion of olefins of less than eighteen (e.g. 15) carbon atoms. In this case, unlike the slurries formed on neutralization of alkyl benzene sulfonic acids, there are substantially no undissolved particles. With suitable mixtures, e.g. obtained from feeds comprising $C_8$–$C_{22}$ olefin mixtures or $C_{15}$–$C_{18}$ olefin mixtures, free-flowing viscous syrups free of solid particles are obtained even at high solids content (well about 40%, e.g. at 60% solids).

The following Examples are given to illustrate this invention further:

EXAMPLE 1

A mixture of alkenyl sulfonates and hydroxyalkanesulfates was made by continuously reacting gaseous $SO_3$ with an alpha-olefin comprising about 25% tetradecene-1, 50% hexadecene-1 and 25% octadecene-1, followed by hydrolysis, neutralization with sodium hydroxide, and extraction to remove inactive oil and salt. The resulting olefin sulfonate detergent product, containing 98% anionically active ingredient, was used to make the following detergent mixtures having excellent foaming and detergent properties:

a. 9% of the above olefin sulfonate detergent, 9% of sodium dodecyl benzene sulfonate, 35% sodium tripolyphosphate, 7% sodium silicate, 8% water and the balance sodium sulfate.

b. 9% of the above olefin sulfonate detergent, 9% of sodium lauryl sulfate (containing about 1% of its weight of lauryl alcohol), 35% sodium tripolyphosphate, 7% sodium silicate, 8% water and the balance sodium sulfate.

The mixtures described in Example 1a and 1b were highly effective detergents of desirable foaming power.

EXAMPLE 2

An olefin sulfonate was produced by reacting $SO_3$ and an olefin feedstock, in about 1:1 molar ratio. The olefin feedstock contained about 88% of teminally unsaturated straight chain olefins having an average molecular weight of 230 and an average chain length of about 15 to 18 carbons ($C_{15}$–24%, $C_{16}$–29%, $C_{17}$–30%, $C_{18}$–17%, approximately), and had a boiling range at atmospheric pressure of about 265°–300° C. (with 11% residue). The reaction with $SO_3$ was carried out in a jacketed tubular reactor having an internal diameter of 0.824 inches and a length of 19'4", in a film-type sulfonation reaction, in which the olefin feedstock was distributed as a falling film over the inner wall of the reaction tube at the top thereof and a gaseous mixture containing 4% by volume of $SO_3$ in air was injected downward at a high volumetric rate into the center of the reaction tube at the top thereof. Reaction temperature was controlled in the neighborhood of 125° F using cooling water in the cooling jacket surrounding the reactor and the pressure in the reaction was about 10 psig. About 40 lbs./hr. of alkene was reacted with about 14 lbs./hr. of sulfur trioxide dispersed in 30 cu.ft./minute of air having a dew point of about −100° F (1 ppm of water).

The Stage I mix from the tubular reactor was separated continuously from entrained gases in a separator at the base of the reactor and then injected continuously into a recycle loop together with 6.5 lbs./hr. of 20% oleum, the recycling mixture in the loop being maintained at a temperature of about 105° F. The average residence time in the recycle loop was about 2–5 minutes, the pressure therein was on the order of 5 psig, and the material continuously leaving the recycle loop was neutralized directly with aqueous dilute sodium hydroxide at a temperature of about 180°–200° F to a pH of 9–10. The resulting neutralized product, which was a syrup containing (on an organic dry basis) 97.1% anionically active ingredient and 2.9% free oil was then used for preparing a series of heavy duty built liquid detergents having the compositions shown in the following table:

| | (1) | (2) | (3) | (4) | (5) |
|---|---|---|---|---|---|
| Olefin sulfonate (proportion given is the amount of anionically active ingredient) | 9 | 7 | 12 | 5 | 6 |
| Potassium Xylene Sulfonate 8.5 | 6 | 8 | 8.5 | 8.5 | |
| Sodium salt of sulfate of ethoxylated linear $C_{14}$–$C_{18}$ alcohol made from three moles of ethylene oxide per mole of the alcohol | 6 | | | | |
| Lauryl-myristyl dimethylamine oxide | | 5 | | | |
| Lauric-myristic diethanolamide | 2 | | | | |
| Lauric-myristic isopropanolamide | 2 | | | | |
| Carboxymethyl cellulose (sodium salt) | 0.25 | 0.25 | 0.25 | 0.25 | 0.25 |
| Polyvinyl alcohol | 0.25 | 0.25 | 0.25 | 0.25 | 0.25 |
| Aqueous emulsion of hydrogenated castor oil, containing 10% of the hydrogenated castor oil | 6 | 6 | 6 | 6 | 6 |
| N-Higher alkyl (mixture of $C_{12}$, $C_{14}$, $C_{16}$) dimethylbenzylammonium chloride | | | 1.5 | | |
| Sodium tallow alcohol sulfate | | | | 3 | |
| Condensate of 10% ethylene oxide with 90% hydrophobic reaction product of propylene oxide and propylene glycol | | | | 2 | |
| Na salt of monosulfonated liner tridecylbenzene | | | | | 9 |

In the above table the proportions given are percentages, by weight, of the named ingredients. Water and builder (and a small amount of dye and fluorescent brighteners) were included in amount sufficient to make a total of 100%.

Although the present invention has been described with reference to particular embodiments and examples, it will be apparent to those skilled in the art that variations and modifications can be substituted therefor without departing from the principles and true spirit of the invention.

What is claimed is:

1. A detergent mixture suitable for use in aqueous liquid detergent compositions consisting essentially of (a) a water-soluble, anionically active olefin sulfonate product having 12 to 21 carbon atoms in the olefin molecular structure, (b) a water-soluble higher alkyl poly (ethenoxy) ether sulfate having 10 to 20 carbon atoms in the higher alkyl group and 1 to 5 ethenoxy groups per molecule, said olefin sulfonate product and said ether sulfate being in the form of a salt selected from the group consisting of sodium, potassium, ammonium and ethanolammonium and (c) a higher fatty acid alkanolamide selected from the group consisting of fatty acid isopropanolamides and fatty acid monoethanolamides in which the higher fatty acyl radical has 10 to 14 carbon atoms, the weight ratio of said sulfate to said sulfonate being in the range of 90:10 to 30:70, said alkanolamide being present in an amount of about ½ to 10% by weight and being effective to improve the foam stability as compared with a composition which does not contain said alkanolamide.

2. A mixture as set forth in claim 1 in which the olefin sulfonate constitutes about ⅓ to 70% by weight of the total detergent mixture.

3. An aqueous detergent having a total solids content of 30% to 80% by weight, said solids content consisting essentially of the detergent mixture set forth in claim 1 and water-soluble sodium or potassium inorganic builder salts selected from the group consisting of phosphates, silicates, carbonates, borates, sulfates and chlorides, the weight ratio of the total organic sulfonate and sulfate detergents to inorganic builder salts being in the range of about 1:1 to 1:20.

4. An aqueous detergent in accordance with claim 3 wherein said builder salts comprise a potassium polyphosphate and said composition further contains a water-soluble lower alkyl benzene sulfonate salt having 1–2 methyl groups on the benzene as a hydrotrope, said hydrotrope being present in an amount of from ½ to 10% by weight.

* * * * *